US009583818B2

(12) United States Patent
Shimura

(10) Patent No.: US 9,583,818 B2
(45) Date of Patent: Feb. 28, 2017

(54) METAMATERIAL

(71) Applicant: CANON KABUSHIKI KAISHA, Tokyo (JP)

(72) Inventor: Hajime Shimura, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 134 days.

(21) Appl. No.: 14/578,984

(22) Filed: Dec. 22, 2014

(65) Prior Publication Data

US 2015/0214630 A1 Jul. 30, 2015

(30) Foreign Application Priority Data

Jan. 30, 2014 (JP) ..... 2014-016197

(51) Int. Cl.

| | |
|---|---|
| ***H01Q 15/02*** | (2006.01) |
| ***H01Q 1/24*** | (2006.01) |
| ***H01Q 1/52*** | (2006.01) |
| ***H01Q 9/42*** | (2006.01) |
| ***H01Q 15/00*** | (2006.01) |

(52) U.S. Cl.

CPC ..... *H01Q 1/243* (2013.01); *H01Q 1/521* (2013.01); *H01Q 9/42* (2013.01); *H01Q 15/008* (2013.01); *H01Q 15/0086* (2013.01)

(58) Field of Classification Search

CPC ..... H01Q 1/46; H01Q 9/42; H01Q 12/10; H01Q 11/08

USPC ..... 343/909, 753, 912, 895

See application file for complete search history.

(56) References Cited

U.S. PATENT DOCUMENTS

| | | | | |
|---|---|---|---|---|
| 2004/0160367 | A1* | 8/2004 | Mendolia | H01Q 15/008 343/700 MS |
| 2011/0102297 | A1* | 5/2011 | Ikawa | H01Q 1/425 343/907 |

FOREIGN PATENT DOCUMENTS

| | | | |
|---|---|---|---|
| JP | 2002-510886 | A | 4/2002 |
| JP | 2010-016554 | A | 1/2010 |
| JP | 2010-502131 | A | 1/2010 |
| JP | 2011-040703 | A | 2/2011 |
| JP | 2012-065371 | A | 3/2012 |
| WO | 99/50929 | A1 | 10/1999 |
| WO | 2008/024993 | A2 | 2/2008 |

* cited by examiner

*Primary Examiner* — Dameon E Levi
*Assistant Examiner* — Collin Dawkins
(74) *Attorney, Agent, or Firm* — Carter, DeLuca, Farrell & Schmidt, LLP

(57) ABSTRACT

A metamaterial is configured by arranging at least one element on a planar conductor plate, where the at least one element has a first conductor portion arranged a predetermined distance away from the conductor plate in a two-dimensional plane that includes the conductor plate, and a second conductor portion arranged so as to connect the conductor plate and the first conductor portion.

12 Claims, 8 Drawing Sheets

PRIOR ART

EQUIVALENT CIRCUIT OF TRANSMISSION LINE MADE OF RIGHT-HANDED (RH) MATERIAL

EQUIVALENT CIRCUIT OF TRANSMISSION LINE MADE OF LEFT-HANDED (LH) METAMATERIAL

EQUIVALENT CIRCUIT OF TRANSMISSION LINE MADE OF COMPOSITE RIGHT/LEFT-HANDED (CRLH) METAMATERIAL

PRIOR ART

PRIOR ART

METAMATERIAL

BACKGROUND OF THE INVENTION

Field of the Invention

The present invention relates to a metamaterial structure formed in a pattern on a printed circuit board.

Description of the Related Art

In recent years, attention has been placed on research in metamaterial technology. The use of metamaterial technology makes it possible to construct materials having properties that do not exist in nature and have never been achievable before. Review has been underway for the application of metamaterial technology to electromagnetic bandgap structures (referred to hereinafter as "EBG structures"), structures having effects similar to a magnetic wall, antenna elements, structures for improving antenna characteristics (radiation pattern, etc.), RF devices, and the like.

For example, an EBG structure has been proposed as a method of preventing electromagnetic interference between electronic components and circuits (e.g., see Japanese Patent Laid-Open No. 2011-040703). Technology has also been disclosed for reducing the thickness and size of an antenna by using the characteristics of an EBG structure to suppress mutual interference between antennas and causing the EBG structure to function as a magnetic wall as well (e.g., Japanese Patent Laid-Open No. 2012-65371). There has also been a proposal regarding an antenna that utilizes a metamaterial structure (e.g., Japanese Patent Laid-Open No. 2010-502131). Furthermore, there has been a proposal regarding a method of reducing surface current induced on the ground plate by an antenna (e.g., Japanese Patent Laid-Open No. 2002-510886). Moreover, there has been a proposal for a configuration in which a capacitance forming conductor is provided in the configuration proposed in Japanese Patent Laid-Open No. 2002-510886 (e.g., Japanese Patent Laid-Open No. 2010-16554).

Conventionally, there has been a proposal for a method of arranging metamaterial cells in a direction perpendicular to a surface of the ground plate, and there has also been a proposal regarding technology for reducing the size of such cells. There has also been a proposal regarding a method of constructing an EBG structure in the periphery of the ground plate of a circuit board. However, there has been a problem of the inability to realize a sufficient reduction in size with conventional technology.

SUMMARY OF THE INVENTION

In light of the aforementioned circumstances, the present invention provides a metamaterial structure that is compact and can be provided in the periphery of the ground plate of a circuit board.

According to one aspect of the present invention, there is provided a metamaterial configured by arranging at least one element on a planar conductor plate, the at least one element having: a first conductor portion arranged a predetermined distance away from the conductor plate in a two-dimensional plane that includes the conductor plate; and a second conductor portion arranged so as to connect the conductor plate and the first conductor portion.

Further features of the present invention will become apparent from the following description of exemplary embodiments with reference to the attached drawings.

DESCRIPTION OF THE EMBODIMENTS

First Embodiment

The following describes a first embodiment of the present invention with reference to the drawings. Letting E represent the electric field, H represent the magnetic field, and k represent the wave vector, the propagation of electromagnetic waves in most substances has the characteristic that E, H, and k follow the right-hand rule. The direction of the wave vector, that is to say the direction in which the phase travels, is the same as the Poynting vector direction. Such a material is called a right-handed (RH) material. Most of the materials that exist in nature are RH materials.

On the other hand, a metamaterial is a man-made structure. If the size of the cells in a metamaterial structure is designed so as to be much smaller than the wavelength of electromagnetic waves, the metamaterial can possibly behave as a homogenous medium with respect to electromagnetic energy. In a metamaterial, the direction of the wave vector, that is to say the direction in which the phase travels, is the opposite of the Poynting vector direction, and E, H, and k follow the left-hand rule. Such a material is called a left-handed (LH) metamaterial. Normally, it is difficult to construct a purely left-handed (LH) metamaterial, and most metamaterials are mixtures of a LH metamaterial and an RH material. This is called a composite right/left-handed (CRLH) metamaterial. The use of this metamaterial technology makes it possible to construct materials having characteristics that do not exist in nature and have never been achievable before. By appropriately designing a structure using a metamaterial, the structure can be caused to operate as an EBG structure, a structure having effects similar to a magnetic wall, an antenna element, a structure for improving antenna characteristics (radiation pattern, etc.), an RF device, and the like.

Figure 1:
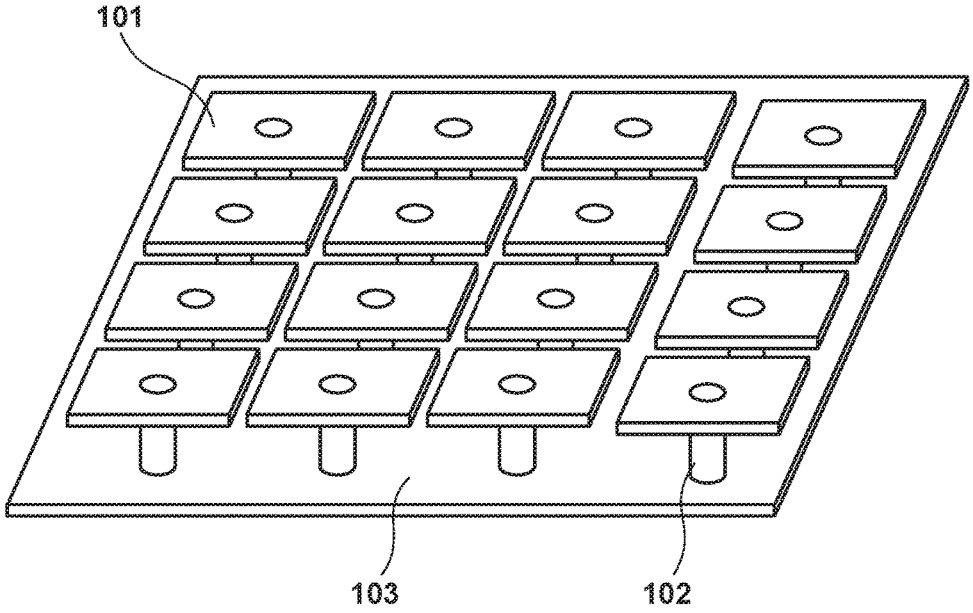
FIG. 1 is a diagram showing a metamaterial structure according to conventional technology.
Figure 2A:
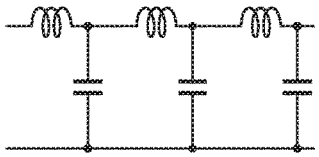
FIGS. 2A to 2C are equivalent circuits of a metamaterial transmission line.
Figure 2B:
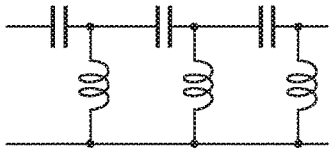
PRIOR ART FIG. 2B
Figure 2C:
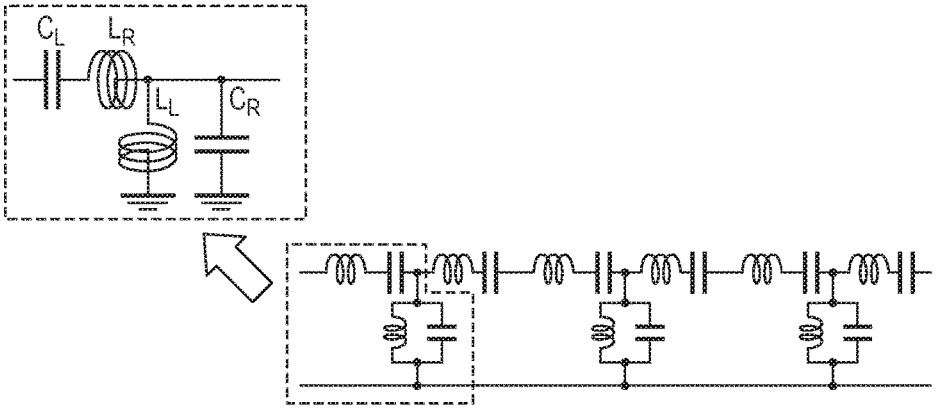
PRIOR ART FIG. 2C

FIG. 1 is a diagram showing a metamaterial structure according to conventional technology. The structure of the material shown in FIG. 1 will be called a mushroom structure below. Also, FIG. 2A shows the equivalent circuit of a transmission line made of a right-handed (RH) material, FIG. 2B shows the equivalent circuit of a transmission line made of a left-handed (LH) metamaterial, and FIG. 2C shows the equivalent circuit of a transmission line made of a composite right/left-handed (CRLH) metamaterial. The metamaterial structure shown in FIG. 1 can be represented by the equivalent circuit of a transmission line made of a composite right/left-handed (CRLH) metamaterial shown in FIG. 2C.

Figure 3:
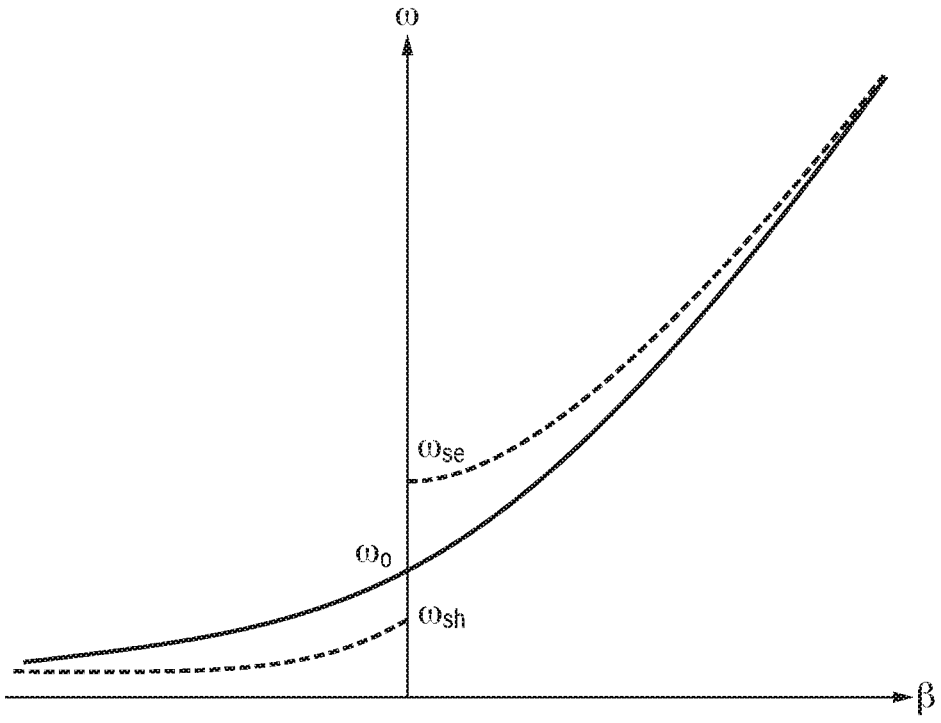
FIG. 3 is a diagram showing dispersion characteristics of a metamaterial transmission line.

A composite right/left-handed (CRLH) metamaterial has a balanced mode in which both the right-handed mode and the left-handed mode are balanced, and an unbalanced mode in which the two modes are not balanced. This will be described below with reference to FIG. 3. FIG. 3 is a diagram showing dispersion characteristics of a metamaterial transmission line. In FIG. 3, the horizontal axis represents the phase constant β, and the vertical axis represents the angular frequency ω.

When attention is directed to the dispersion characteristics indicated by dashed lines in FIG. 3, it can be seen that a bandgap in which β is nonexistent and waves cannot propagate exists between later-described ωse and ωsh. This bandgap is one phenomenon that occurs in the unbalanced mode. Note that the magnitude relationship between ωse and ωsh switches depending on a later-described condition. If ωse and ωsh are matched with each other (let ω0 be the matched frequency), and the balanced condition is satisfied, the bandgap region ceases to exist, and the balanced mode is achieved. In the balanced mode, the metamaterial exhibits the dispersion characteristics indicated by the solid line in FIG. 3, that is to say is in the so-called zero-order mode. In the balanced mode, it is possible to realize a state in which the wavelength is infinite and there is no phase variation at the angular frequency ω0 at which β=0.

In FIG. 3, ωse and ωsh can be expressed as shown below using LR, CL, LL, and CR in the equivalent circuit in FIG. 2C.

$$\omega se = \frac{1}{\sqrt{LR \cdot CL}}$$

$$\omega sh = \frac{1}{\sqrt{LL \cdot CR}}$$

Based on the two expressions above, it can be seen that ωse is determined by LR and CL, and ωsh is determined by LL and CR.

The following describes elements of the equivalent circuit in FIG. 2C that the constituent elements of the cells correspond to in the case where the metamaterial shown in FIG. 1 is a composite right/left-handed (CRLH) metamaterial. With the mushroom structure shown in FIG. 1, the capacitance component generated between adjacent patch conductors 101 mainly contributes as CL in FIG. 2C. The patch conductor length of the patch conductors 101 in FIG. 1 mainly contributes as LR in FIG. 2C. The capacitance component generated between the patch conductors 101 and a ground conductor 103 in FIG. 1 mainly contributes as CR in FIG. 2C. Connection conductors 102 that connect the patch conductors 101 to the ground conductor 103 in FIG. 1 mainly contribute as LL in FIG. 2C.

In this way, even with a composite right/left-handed (CRLH) metamaterial, ωse and ωsh can be set to desired values by appropriately designing the size of the cells (the patch size, the connection conductor diameter, and the connection conductor length) constituting the metamaterial, the inter-cell interval, and the like. In other words, by using an appropriate design in a composite right/left-handed (CRLH) metamaterial, it is possible to control the angular frequencies ωse and ωsh or ω0 in FIG. 3. Accordingly, it is possible to realize a composite right/left-handed (CRLH) metamaterial that has the characteristics of the balanced mode or the unbalanced mode.

Figure 4:
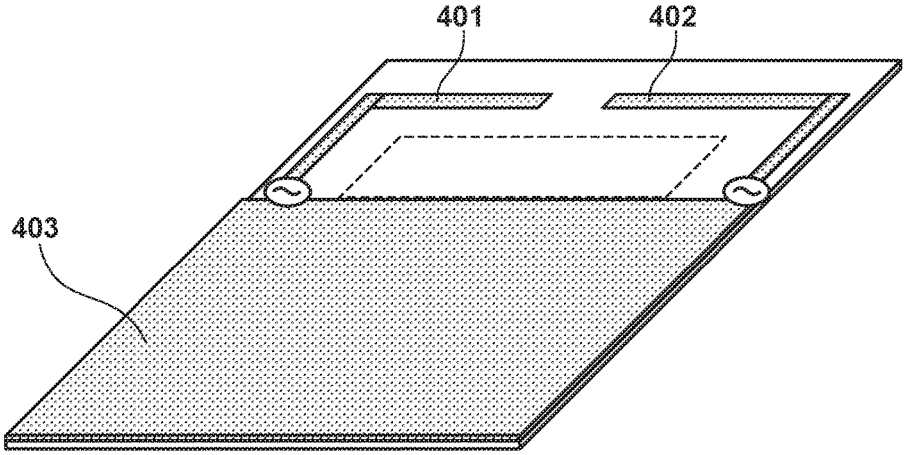
FIG. 4 is a diagram showing two inverted L antennas mounted on a circuit board that has a wireless communication function.

Next, consider the case of applying the above-described metamaterial characteristics to a planar circuit board having a wireless communication function as shown in FIG. 4. FIG. 4 is a schematic diagram of a circuit board that has an MIMO wireless communication function. In this diagram, 401 and 402 indicate inverted L antennas, which are basic antennas. Note that electronic components, electrical circuitry, and the like for realizing the wireless communication function are provided in a ground conductor 403 in FIG. 4. It is common for the antenna elements to be implemented on the circuit board in a portion where part of the conductor portion of the circuit board has been removed as shown in FIG. 4.

Here, due to an EBG structure employing a metamaterial being implemented in the periphery of the ground conductor 403, it is possible to mitigate radiation noise radiated from the edge of the board. However, if the EBG structure provided in the dashed line region in FIG. 4 is the mushroom structure shown in FIG. 1, for example, it is necessary to provide the ground conductor plate of the mushroom structure in the dashed line region in FIG. 4. However, it is known that the antenna characteristics degrade if the ground conductor plate is close to the region of the antennas. In other words, if the mushroom structure that includes a ground is arranged in the vicinity of the inverted L antenna elements, as with the dashed line region in FIG. 4, the ground conductor plate will be close to the region of the inverted L antenna elements, and the antenna characteristics of the inverted L antennas will degrade.

Accordingly, the mushroom structure shown in FIG. 1 degrades the antenna characteristics and therefore is not suitable as the EBG structure to be implemented in the dashed line region in FIG. 4. In view of this, the present embodiment proposes an EBG structure that does not need the provision of a new ground conductor in the dashed line region in FIG. 4 and can be constructed using the ground conductor of the circuit board.

Figure 5:
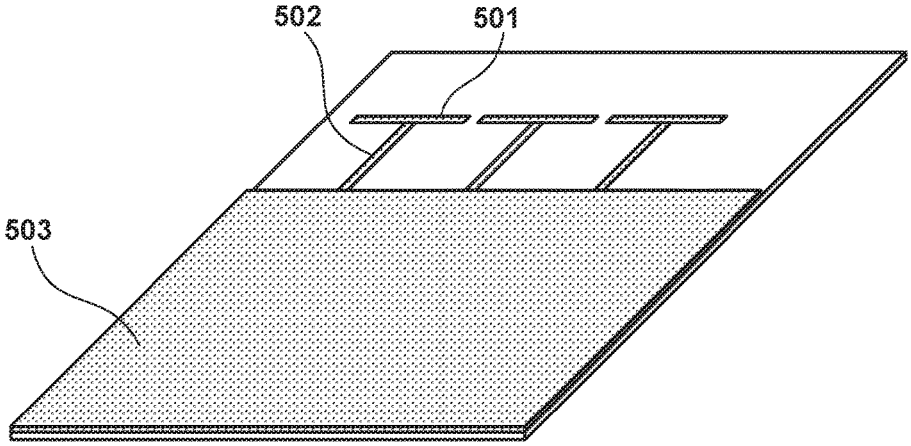
PRIOR ART FIG. 5
FIG. 5 is a diagram showing a metamaterial structure according to a first embodiment.

FIG. 5 is a diagram showing a metamaterial structure according to the present embodiment. Each of the cells constituting the metamaterial in FIG. 5 is made up of a straight-line shaped first conductor portion 501 formed a predetermined distance away from a planar conductor plate such as ground conductor 503 in a two-dimensional plane that includes the ground conductor 503, and a second conductor portion 502 that connects the first conductor portion 501 to the ground conductor 503. As shown in FIG. 5, the first conductor portion 501 can be arranged approximately parallel to the side of the ground conductor 503. A comparison with FIG. 1 shows that the cross-sectional shape of the structure in FIG. 5 is similar to the cross-section of the structure of the cells in the EBG structure shown in FIG. 1. Specifically, the patch conductors 101 in FIG. 1 correspond to the first conductor portions 501 in FIG. 5, the connection conductors 102 in FIG. 1 correspond to the second conductor portions 502 in FIG. 5, and the ground conductor 103 in FIG. 1 correspond to the ground conductor 503 in FIG. 5. Employing this shape in FIG. 5 makes it possible to achieve effects similar to FIG. 1, and makes it possible to realize many functions exhibited by metamaterials.

Also, it can be seen that in the metamaterial structure shown in FIG. 5, the ground conductor of the circuit board serves as the ground conductor of the metamaterial. In other words, in the case of providing the EBG structure in the dashed line region in FIG. 4, it can be seen that there is no need to provide a new ground conductor, and it is possible to reduce the amount of space needed for providing the metamaterial. It can also been seen that it is possible to realize an EBG structure in the dashed line region in FIG. 4 without degrading the antenna characteristics of the inverted L antennas.

Also, in the metamaterial structure shown in FIG. 1, the patch conductors 101 and the ground conductor 103 are connected by the connection conductors 102, and therefore two layers are needed to realize the structure in FIG. 1. Realizing these two layers on a circuit board, for example, requires the connection conductors to be formed by vias, which is costly. However, with the metamaterial structure of the present embodiment shown in FIG. 5, the metamaterial is provided in one layer, and there is no need for the above-described vias or the like.

Also, when realizing the structure in FIG. 1 on a circuit board, the distance between the patch conductors 101 and the ground conductor 103 is limited by the board thickness. However, by providing the ground conductor 503 and the first conductor portions 501 in the same plane as shown in FIG. 5, the distance between the ground conductor 503 and the first conductor portions 501 can be easily controlled, and the capacitance generated between the first conductor portions 501 and the ground conductor 503 can be easily controlled. In other words, compared with the structure in FIG. 1, the metamaterial structure shown in FIG. 5 makes it easier to control the value of CR shown in the equivalent circuit in FIG. 2C.

In this way, in the case of implementing a metamaterial structure in the dashed line region in FIG. 4, the metamaterial structure of the present embodiment shown in FIG. 5 is highly superior to the mushroom structure of conventional technology shown in FIG. 1. Specifically, the metamaterial structure of the present embodiment is highly superior in terms of the amount of space needed to realize the metamaterial structure, cost, and not degrading antenna characteristics, and also in terms of easily controlling the value of CR in the equivalent circuit shown in FIG. 2C. Accordingly, by designing an EBG structure having the above-described characteristics using a metamaterial as shown in FIG. 5, and arranging this EBG structure in the dashed line region in FIG. 4, it is possible to mitigate radiation noise radiated from the edge of the board.

Note that although an EBG structure that can mitigate radiation noise radiated from the edge of the board is described above, the applicable scope of the metamaterial in FIG. 5 is not limited to an EBG structure. An EBG structure is one type of structure that exhibits the characteristics of a metamaterial, and the functions of a structure other than an EBG structure can be realized by appropriately designing the metamaterial structure.

For example, it is possible to design an EBG structure for preventing electromagnetic interference between electronic components and circuitry. It is also possible for a metamaterial to operate as an antenna. For example, in the case of constructing an antenna using the zero-order mode described with reference to FIG. 3, it is possible to match the angular frequencies ωse and ωsh at the matched frequency ω0 and design an antenna with the angular frequency ω0, and design an antenna with a band in which the phase constant is negative. Accordingly, through the design, it is possible to realize an antenna that is more compact than in conventional technology. In this way, by constructing an antenna through appropriately designing the metamaterial shown in FIG. 5, it is possible to implement that antenna on a circuit board having a wireless communication function instead of the inverted L antennas 401 and 402 shown in FIG. 4.

Second Embodiment

The first embodiment describes a metamaterial having the configuration shown in FIG. 5. The present embodiment proposes a structure that enables increasing the capacitance component of CL in the equivalent circuit in FIG. 2C, in the metamaterial shown in FIG. 5. According to the present embodiment, it is possible to realize a further reduction in the size of the metamaterial structure, and it is possible to improve design flexibility.

As described in the first embodiment, the patch conductors 101 in FIG. 1 correspond to the first conductor portions 501 in FIG. 5, the connection conductors 102 in FIG. 1 correspond to the second conductor portions 502 in FIG. 5, and the ground conductor 103 in FIG. 1 correspond to the ground conductor 503 in FIG. 5. In other words, with the shape shown in FIG. 5, it is possible to achieve effects similar to FIG. 1 and realize many functions exhibited by metamaterials. However, a comparison of the patch conductors 101 in FIG. 1 and the first conductor portions 501 in FIG. 5 shows that whereas the patch conductors 101 in FIG. 1 are formed so as to be planar, the first conductor portions 501 in FIG. 5 are formed in a linear pattern on the circuit board.

Here, consider the element CL component in the equivalent circuit in FIG. 2C in the metamaterial configurations shown in FIG. 5. CL mainly represents the capacitance component formed between adjacent cell patches in FIG. 1, and in FIG. 5, CL represents the capacitance component formed between the first conductor portions of adjacent cells. This capacitance component is obtained based on the areas of the two conductors between which the capacitance component is formed, and based on the distance between the two conductors. In other words, the larger the area of the conductors is, the larger the capacitance component that can be stored is, and the shorter the distance between the two conductors is, the larger the capacitance component that can be stored is. A comparison of the patch conductors 101 in FIG. 1 and the first conductor portions 501 in FIG. 5 shows that the conductor area is smaller with the first conductor portions 501 in FIG. 5. For this reason, the capacitance component formed between the first conductor portions 501 of adjacent cells in FIG. 5 is smaller than the capacitance component formed between the patch conductors 101 of adjacent cells in FIG. 1. As described above, the capacitance component CL is an element that determines ωse, and therefore the inability to obtain a large capacitance component CL is a hindrance to reducing the size of the metamaterial structure. It also lowers the design flexibility when designing the metamaterial structure.

Figure 6:
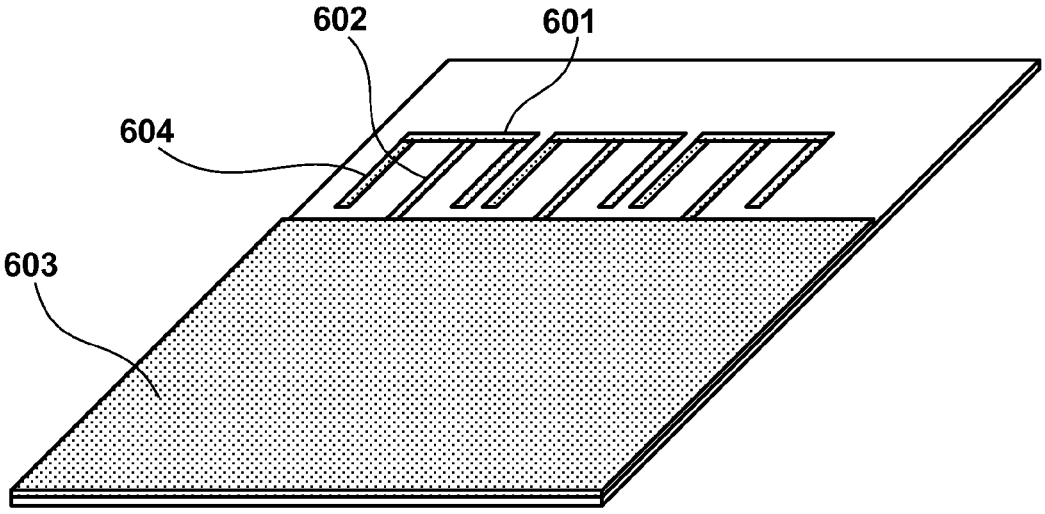
FIG. 6 is a diagram showing a metamaterial structure according to a second embodiment.

In view of this, the present embodiment proposes a configuration that enables further increasing the capacitance component between the cells constituting the metamaterial. FIG. 6 is a diagram showing a metamaterial structure according to the present embodiment. The first conductor portions 501 in FIG. 5 correspond to the first conductor portions 601 in FIG. 6, the second conductor portions 502 in FIG. 5 correspond to the second conductor portions 602 in FIG. 6, and the ground conductor 503 in FIG. 5 correspond to the ground conductor 603, which is a planar conductor plate, in FIG. 6. A comparison with FIG. 5 shows that in the metamaterial structure in FIG. 6, a new straight-line shaped third conductor portion 604 that extends toward the ground plate is formed at each of the two ends of a first conductor portion 601. As shown in FIG. 6, the third conductor portions 604 can be provided approximately perpendicular to the side of a ground conductor 603. In comparison with FIG. 5, the metamaterial structure in FIG. 6 enables further increasing the capacitance component between adjacent cells constituting the metamaterial. Also, in comparison with FIG. 5, the metamaterial structure in FIG. 6 enables reducing the size of the metamaterial structure and also improving design flexibility. Note that the third conductor portions 604 influence not only the capacitance component CL in the equivalent circuit in FIG. 2C, but also the constants of other circuit elements.

In this way, the metamaterial structure of the present embodiment shown in FIG. 6 obtains the above-described effects in addition to the effects described in the first embodiment. Note that the applicable scope of the present embodiment can also be expanded as described in the first embodiment.

Third Embodiment

The second embodiment describes a metamaterial having the configuration shown in FIG. 6. The present embodiment proposes a structure that enables increasing the capacitance component of CR in the equivalent circuit in FIG. 2C, in the metamaterial shown in FIG. 6. According to the present embodiment, it is possible to realize a further reduction in the size of the metamaterial structure, and it is possible to improve design flexibility.

As described in the first embodiment, the patch conductors 101 in FIG. 1 correspond to the first conductor portions 501 in FIG. 5, the connection conductors 102 in FIG. 1 correspond to the second conductor portions 502 in FIG. 5, and the ground conductor 103 in FIG. 1 correspond to the ground conductor 503 in FIG. 5. In other words, with the shape shown in FIG. 5, it is possible to achieve effects similar to FIG. 1 and realize many functions exhibited by metamaterials. However, a comparison of the patch conductors 101 in FIG. 1 and the first conductor portions 501 in FIG. 5 shows that whereas the patch portions in FIG. 1 are formed so as to be planar, the first conductor portions 501 in FIG. 5 are formed in a linear pattern on the circuit board.

Here, consider the element CR component in the equivalent circuit in FIG. 2C in the metamaterial configurations shown in FIG. 5. CR mainly represents the capacitance component formed between the patch conductors 101 and the ground conductor 103 in FIG. 1, and in FIG. 5, CR mainly represents the capacitance component formed between the first conductor portions 501 and the ground conductor 503. As described in the second embodiment, this capacitance component is obtained based on the areas of the two conductors between which the capacitance component is formed, and based on the distance between the two conductors. In other words, the larger the area of the conductors is, the larger the capacitance component that can be stored is, and the shorter the distance between the two conductors is, the larger the capacitance component that can be stored is. A comparison of the patch conductors 101 in FIG. 1 and the first conductor portions 501 in FIG. 5 shows that the amount of area opposing the ground conductor is smaller with the first conductor portions 501 in FIG. 5. For this reason, the capacitance component formed between the first conductor portions 501 and the ground conductor 503 in FIG. 5 is smaller than the capacitance component formed between the patch conductors 101 and the ground conductor 103 in FIG. 1. As described above, the capacitance component CR is an element that determines ωsh, and therefore the inability to obtain a large capacitance component CR is a hindrance to reducing the size of the metamaterial structure. It also lowers the design flexibility when designing the metamaterial structure.

Figure 7:
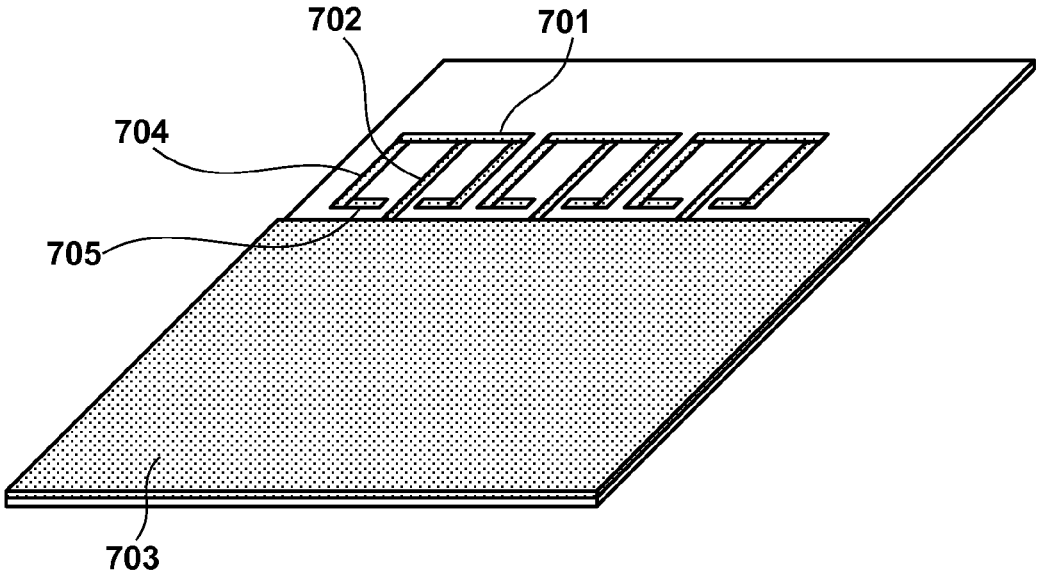
FIG. 7 is a diagram showing a metamaterial structure according to a third embodiment.

In view of this, the present embodiment proposes a configuration that enables further increasing the capacitance component between the ground conductor and the cells constituting the metamaterial. FIG. 7 is a diagram showing a metamaterial structure according to the present embodiment. The first conductor portions 601 in FIG. 6 correspond to the first conductor portions 701 in FIG. 7, the second conductor portions 602 in FIG. 6 correspond to the second conductor portions 702 in FIG. 7, the ground conductor 603 in FIG. 6 correspond to the ground conductor 703, which is a planar conductor plate, in FIG. 7, the third conductor portions 604 in FIG. 6 correspond to the third conductor portions 704 in FIG. 7. A comparison with FIG. 6 shows that in the metamaterial structure in FIG. 7, a new straight-line shaped fourth conductor portion 705 that extends parallel to the side of a ground conductor 703 is formed at an end of each of third conductor portions 704. As shown in FIG. 7, the fourth conductor portion 705 can be provided approximately parallel to the side of the ground conductor 703. In comparison with FIG. 6, the metamaterial structure in FIG. 7 enables further increasing the capacitance component between the ground conductor and the cells constituting the metamaterial. Also, in comparison with FIG. 5, the metamaterial structure in FIG. 6 enables reducing the size of the metamaterial structure and also improving design flexibility. Note that the fourth conductor portions 705 influence not only the capacitance component CR in the equivalent circuit in FIG. 2C, but also the constants of other circuit elements.

Also, another conductor portion may be additionally formed at an end of each of the fourth conductor portions 705. The additionally formed conductor portions may have a straight-line shape, a meander-line shape, a spiral shape, or the like. Accordingly, it is possible to further increase the capacitance component formed with the cells constituting the metamaterial and between adjacent cells. It is also possible to further increase the capacitance component between the ground conductor and the cells constituting the metamaterial.

In this way, the metamaterial structure of the present embodiment shown in FIG. 7 obtains the above-described effects in addition to the effects described in the first embodiment. Note that the applicable scope of the present embodiment can also be expanded as described in the first embodiment.

Fourth Embodiment

The second embodiment describes a configuration that enables further increasing the capacitance component between the cells constituting the metamaterial, and the third embodiment describes a configuration that enables further increasing the capacitance component between the ground conductor and elements constituting the metamaterial. The present embodiment proposes a structure that enables increasing the inductance component of LL in the equivalent circuit in FIG. 2C, in the metamaterial shown in FIG. 5. According to the present embodiment, it is possible to realize a further reduction in the size of the metamaterial structure, and it is possible to improve design flexibility.

As described in the first embodiment, the patch conductors 101 in FIG. 1 correspond to the first conductor portions 501 in FIG. 5, the connection conductors 102 in FIG. 1 correspond to the second conductor portions 502 in FIG. 5, and the ground conductor 103 in FIG. 1 correspond to the ground conductor 503 in FIG. 5. In other words, with the shape shown in FIG. 5, it is possible to achieve effects similar to FIG. 1 and realize many functions exhibited by metamaterials. A comparison of the connection conductors 102 in FIG. 1 and the second conductor portions 502 in FIG. 5 shows that whereas the connection conductors 102 are formed by columnar conductors, the second conductor portions 502 are formed in a linear pattern on the circuit board.

Here, consider the element LL component in the equivalent circuit in FIG. 2C in the metamaterial configurations shown in FIG. 5. LL mainly represents the inductance component formed by the connection conductors in FIG. 1, and in FIG. 5, LL mainly represents the inductance component formed by the second conductor portions. The longer the length of the conductors that form the inductance component is, the larger the inductance component that can be obtained is, and the smaller the cross-sectional area of the conductors is, the larger the inductance component that can be obtained is. As described above, the inductance component LL is an element that determines ωse, and therefore the ability to obtain a high inductance component LL is important to reducing the size of the metamaterial structure and improving design flexibility.

Figure 8:
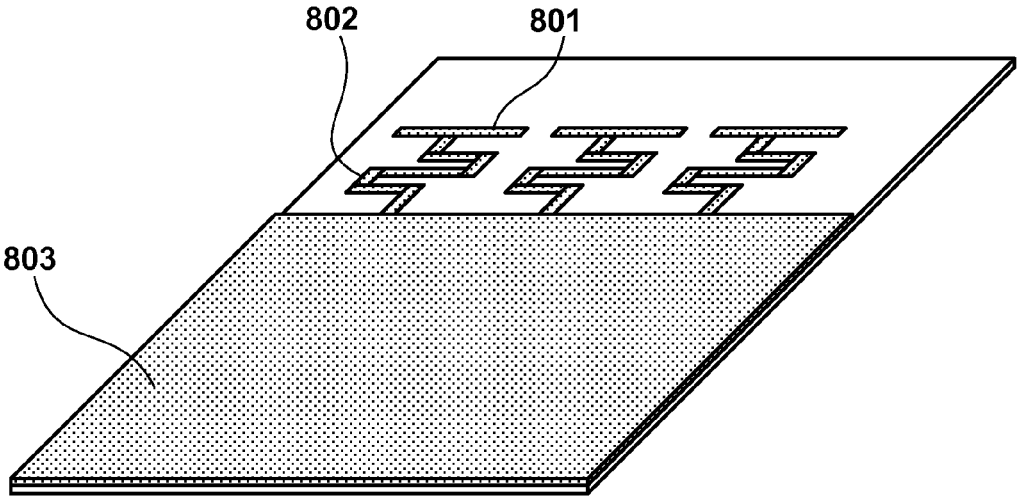
FIG. 8 is a diagram showing a metamaterial structure according to a fourth embodiment.

In view of this, the present embodiment proposes a configuration that enables further increasing the parallel inductance component (LL) in the equivalent circuit in FIG. 2C that configures the metamaterial. FIG. 8 is a diagram showing a metamaterial structure according to the present embodiment. The first conductor portions 501 in FIG. 5 correspond to the first conductor portions 801 in FIG. 8, the second conductor portions 502 in FIG. 5 correspond to the second conductor portions 802 in FIG. 8, and the ground conductor 503 in FIG. 5 correspond to the ground conductor 803, which is a planar conductor plate, in FIG. 8. A comparison with FIG. 5 shows that in the metamaterial structure in FIG. 8, second conductor portions 802 that correspond to the second conductor portions 502 in FIG. 5 are meander-line shaped (serpentine shaped). In other words, the length of the conductor portions can be increased, thus making it possible to increase the inductance component. Accordingly, compared to the case where the second conductor portions 502 are straight-line shaped as shown in FIG. 5, the case where the conductor portions are meander-line shaped as with the second conductor portions 802 in FIG. 8 enables increasing the inductance component, and it is possible to reduce the size of the metamaterial structure and improve design flexibility.

In this way, the metamaterial structure of the present embodiment shown in FIG. 8 obtains the above-described effects in addition to the effects described in the first embodiment. Note that the applicable scope of the present embodiment can also be expanded as described in the first embodiment.

Fifth Embodiment

The fourth embodiment describes a configuration that enables further increasing the inductance component of the second conductor portions. The present embodiment describes a configuration that enables further increasing the inductance component of the second conductor portions compared to FIG. 8 in the fourth embodiment. As described above, the inductance component LL is an element that determines ωse, and therefore the ability to obtain a high inductance component LL is important to reducing the size of the metamaterial structure and improving design flexibility. As described in the fourth embodiment, the longer the length of the conductors that form the inductance component is, the larger the inductance component that can be obtained is, and the smaller the cross-sectional area of the conductors is, the larger the inductance component that can be obtained is. On the other hand, it is known that a spiral shape such as a coil enables obtaining an even larger inductance component.

Figure 9:
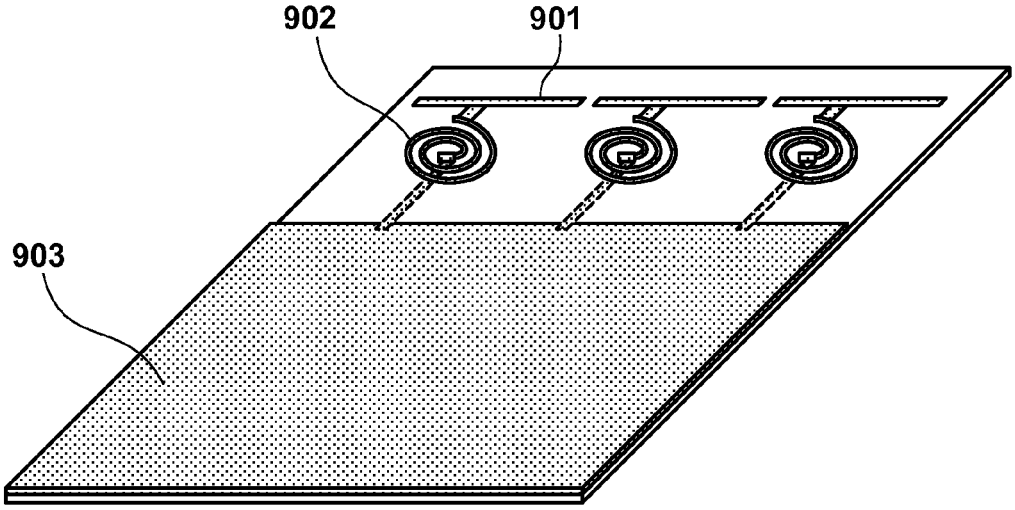
FIG. 9 is a diagram showing a metamaterial structure according to a fifth embodiment.

In view of this, the present embodiment proposes a configuration for obtaining an even larger inductance component. FIG. 9 is a diagram showing a metamaterial structure according to the present embodiment. The first conductor portions 501 in FIG. 5 correspond to the first conductor portions 901 in FIG. 9, the second conductor portions 502 in FIG. 5 correspond to the second conductor portions 902 in FIG. 9, and the ground conductor 503 in FIG. 5 correspond to the ground conductor 903, which is a planar conductor plate, in FIG. 9. Second conductor portions 902 corresponding to the second conductor portions 502 in FIG. 5 are formed with a spiral shape, thus achieving a configuration that enables obtaining an even larger inductance component. Since the second conductor portions 902 are spiral shaped in this case, portions of the second conductor portions 902 need to pass through another layer as shown in FIG. 9. The second conductor portions 902 may be connected to the ground conductor 903 in the plane in which first conductor portions 901 are formed, and in the case where the ground conductor 903 is constituted in multiple layers, the second conductor portions 902 may be connected to the ground conductor 903 in those layers.

The following describes the influence on LL in the equivalent circuit in FIG. 2C due to the difference between the conventional metamaterial structure shown in FIG. 1 and the metamaterial structure of the present embodiment shown in FIG. 9. As previously described, the smaller the cross-sectional area of the conductors is, the larger the inductance component that can be obtained is. In the conventional metamaterial structure shown in FIG. 1, the patch conductors 101 and the ground conductor 103 are connected by the connection conductors 102, and therefore two layers are needed to realize the structure in FIG. 1. Realizing these two layers on a circuit board, for example, requires the connection conductors to be formed by vias that pass through the layers of the board. However, in current manufacturing technology, the diameter of these vias is relatively larger than the width used in the pattern formed on the board.

Specifically, since vias are necessary in the conventional metamaterial structure shown in FIG. 1, the cross-sectional area of the conductors corresponding to LL in the equivalent circuit in FIG. 2C increases. However, with the configuration of the present embodiment shown in FIG. 9, the conductors corresponding to LL in the equivalent circuit in FIG. 2C can be manufactured with a small cross-sectional area. In other words, with the present embodiment, it is possible to construct LL having a larger inductance component even when using connection conductors having the same length as in the conventional technology shown in FIG. 1. As described above, it is possible to construct LL having a larger inductance component, thus making it possible to reduce the size of the metamaterial structure and improve design flexibility. Note that the above-described effects can be obtained with the meander-line shaped (serpentine shaped) second conductor portions 802 described in the fourth embodiment as well.

In this way, the metamaterial structure of the present embodiment shown in FIG. 9 obtains the above-described effects in addition to the effects described in the first embodiment. Note that the applicable scope of the present embodiment can also be expanded as described in the first embodiment.

Sixth Embodiment

The second to fifth embodiments describe metamaterial configurations in which mainly CL, LL, and CR in the equivalent circuit in FIG. 2C are further increased compared to the first embodiment. The present embodiment describes a case of combining the second to fifth embodiments. Using a combination of the metamaterial configurations described in the aforementioned embodiments enables exhibiting greater effects.

Figure 10:
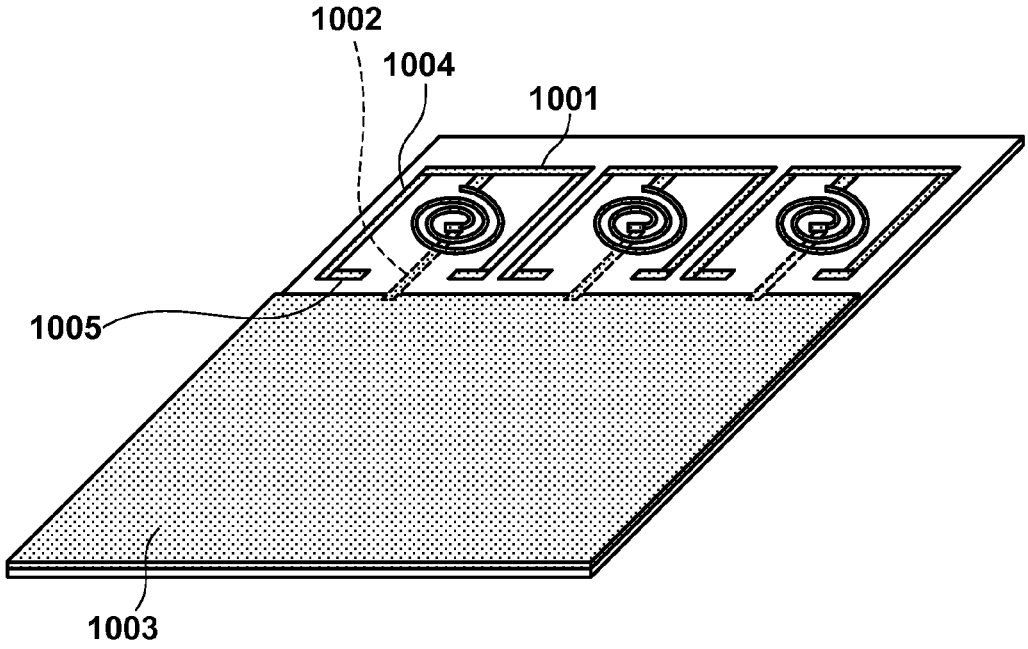
FIG. 10 is a diagram showing a metamaterial structure according to a sixth embodiment.
Figure 11:
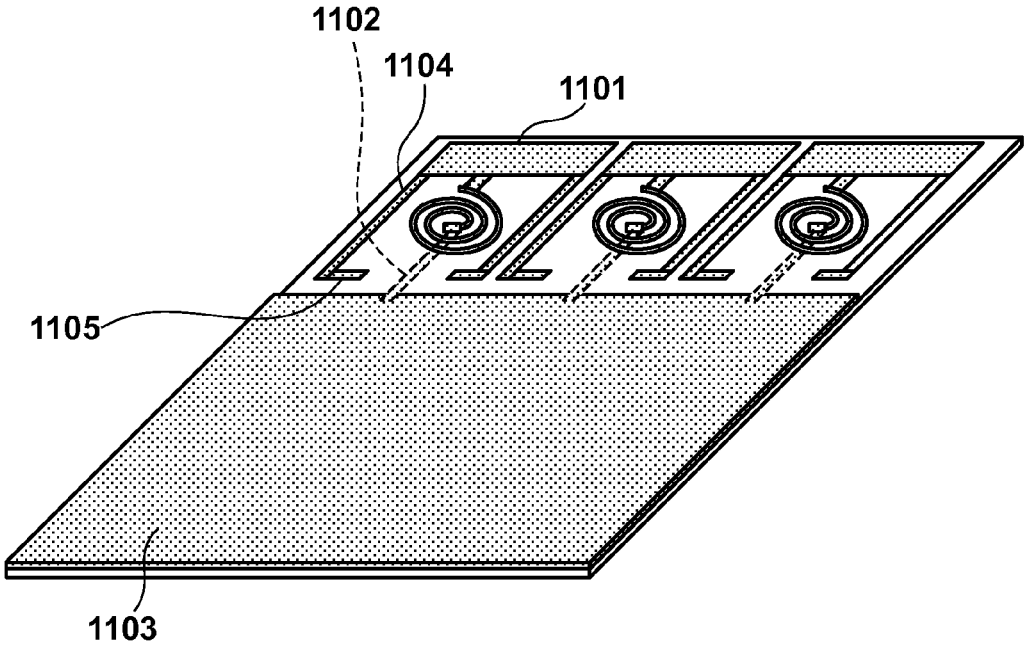
FIG. 11 is a diagram (part 1) showing a metamaterial structure according to a seventh embodiment.

FIG. 10 is a diagram showing a configuration obtained by combining the configurations of the second, third, and fifth embodiments, as one example of a combination. The first conductor portions 601 in FIG. 6 correspond to the first conductor portions 1001 in FIG. 10, the second conductor portions 902 in FIG. 9 correspond to the second conductor portions 1002 in FIG. 10, the ground conductor 603 in FIG. 6 correspond to the ground conductor 1003, which is a planar conductor plate, in FIG. 10, the third conductor portions 704 in FIG. 7 correspond to the third conductor portions 1004 in FIG. 10, and the fourth conductor portions 705 in FIG. 7 correspond to the fourth conductor portions 1005 in FIG. 10. By using a combination of the configurations of the above-described embodiments in this way, it is possible to increase the constants of the respective elements in the equivalent circuit in FIG. 2C. This leads to a reduction in the size of the metamaterial structure, and makes it possible to improve design flexibility. Also, although the line width in the pattern formed on the circuit board is uniform in FIG. 10, the line width in the pattern may be non-uniform as shown in FIG. 11. The first conductor portions 1001, the second conductor portions 1002, the ground conductor 1003, the third conductor portions 1004, and the fourth conductor portions 1005 in FIG. 10 correspond to the first conductor portions 1101, the second conductor portions 1102, the ground conductor 1103 (which is a planar conductor plate), the third conductor portions 1104, and the fourth conductor portions 1105 in FIG. 11, respectively. As described above, the larger the area of the conductors is, the larger the capacitance component that can be stored is, and therefore a wider pattern line width makes it possible to store a larger capacitance component. Also, the smaller the cross-sectional area of the conductors is, the larger the inductance component that can be obtained is, and therefore a narrower pattern line width makes it possible to obtain a larger inductance component. When designing a metamaterial, if many parameters can be easily adjusted, characteristics can be easily controlled and design is made easier, and the pattern line width can also be a parameter used for characteristic adjustment. The pattern on the circuit board can be adjusted so as to be finer using the line width, the pattern positions, and the like, and this has an advantage of making design easier compared to the conventional configuration shown in FIG. 1. Also, as described above, the characteristics of the metamaterial are obtained by CL, LL, CR, and LR in the equivalent circuit shown in FIG. 2C being realized with a pattern on a board. The shapes of the conductor portions constituting the metamaterial may have any shape as long as they form a pattern that realizes the equivalent circuit in FIG. 2C, and there is no limitation to the shapes shown in the drawings.

In this way, the metamaterial structures of the present embodiment shown in FIGS. 10 and 11 obtain effects such as those described above, in addition to the effects described in the first to fifth embodiments. Note that the applicable scope of the present embodiment can also be expanded as described in the first embodiment.

Seventh Embodiment

Figure 12:
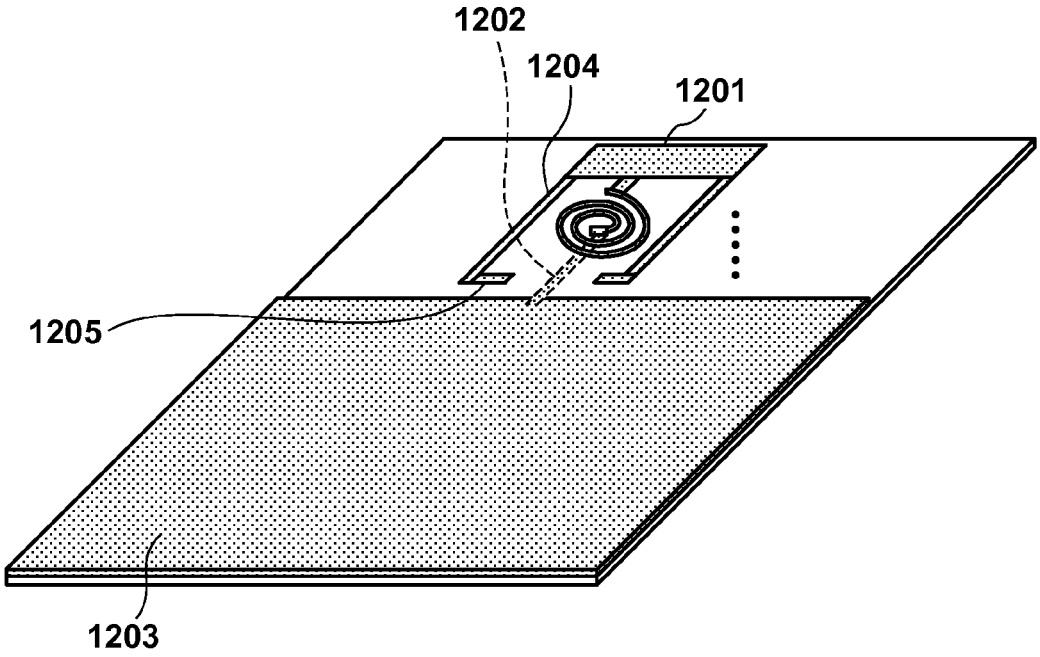
FIG. 12 is a diagram (part 2) showing a metamaterial structure according to the seventh embodiment.

The present embodiment describes the arrangement of cells in the metamaterial described in the first to sixth embodiments. In the metamaterial described in the first to sixth embodiments, multiple cells are arranged in a line in the same plane as the circuit board as shown in FIGS. 5 to 11. However, multiple cells may be arranged in a line extending in a direction perpendicular to a surface (e.g., a side surface) of the ground conductor of the plated circuit as shown in FIG. 12. The first conductor portions 1001, the second conductor portions 1002, the ground conductor 1003, the third conductor portions 1004, and the fourth conductor portions 1005 in FIG. 10 correspond to the first conductor portions 1201, the second conductor portions 1202, the ground conductor 1203 (which is a planar conductor plate), the third conductor portions 1204, and the fourth conductor portions 1205 in FIG. 12, respectively. The configuration shown in FIG. 12 enables increasing the amount of opposing area of adjacent cells, for example, thus making it possible to increase CL in the equivalent circuit in FIG. 2C. Also, it is possible to increase the number of cells even though the cells of the metamaterial occupy the same amount of area in a view from above the circuit board. Note that multiple cells may of course be arranged in a line in the same plane as the circuit board, or may be arranged in a line extending in a direction perpendicular to a surface of the ground conductor of the plated circuit.

In this way, the metamaterial structure of the present embodiment as shown in FIG. 12 obtains effects such as those described above, in addition to the effects described in the first to sixth embodiments. Note that the applicable scope of the present embodiment can also be expanded as described in the first embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-016197, filed Jan. 30, 2014 which is hereby incorporated by reference herein in its entirety.

What is claimed is:

1. A metamaterial configured by arranging at least one element on a planar conductor plate, the at least one element having:

a first conductor portion arranged a predetermined distance away from the conductor plate in a two-dimensional plane that includes the conductor plate; and a second conductor portion arranged so as to connect the conductor plate and the first conductor portion, wherein the element further has a third conductor portion that is arranged so as to be connected to an end portion of the first conductor portion, is approximately perpendicular to a straight-line shaped side of the conductor plate, and is straight-line shaped and extends toward the straight-line shaped side, and wherein the element further has a fourth conductor portion that is arranged so as to be connected to an end portion of the third conductor portion, is approximately parallel to a straight-line shaped side of the conductor plate, and is straight-line shaped and extends toward the second conductor portion.

2. The metamaterial according to claim 1, wherein in the element, the first conductor portion is arranged approximately parallel to a straight-line shaped side of the conductor plate, and the second conductor portion is arranged approximately perpendicular to a straight-line shaped side of the conductor plate.

3. The metamaterial according to claim 1, wherein in the element, the first conductor portion is straight-line shaped, and the straight-line shaped side of the conductor plate and the first conductor portion are approximately parallel.

4. The metamaterial according to claim 1, wherein in the element, the second conductor portion is meander-line shaped.

5. The metamaterial according to claim 1, wherein in the element, the second conductor portion is spiral shaped.

6. The metamaterial according to claim 1, wherein in the element, the line widths of the first conductor portion and the second conductor portion are the same.

7. The metamaterial according to claim 1, wherein in the element, the line widths of the first conductor portion and the second conductor portion are different.

8. The metamaterial according to claim 1, wherein a plurality of the elements are arranged in a line along a straight-line shaped side of the conductor plate.

9. The metamaterial according to claim 1, wherein a plurality of the elements are arranged in a line extending in a direction perpendicular to the two-dimensional plane that includes the conductor plate, along a side surface of the conductor plate.

10. The metamaterial according to claim 1, wherein the conductor plate has a plurality of sides, and a plurality of the elements are arranged in a line extending along each of the plurality of sides of the conductor plate.

11. The metamaterial according to claim 1, wherein the conductor plate has a plurality of sides, and a plurality of the elements are arranged in a line extending in a direction perpendicular to the two-dimensional plane that includes the conductor plate, along each of the plurality of side surfaces of the conductor plate.

12. The metamaterial according to claim 1, wherein the metamaterial has a characteristic of an antenna, an EBG structure, or a magnetic wall.

* * * * *